US008330369B2

(12) United States Patent
Sako et al.

(10) Patent No.: US 8,330,369 B2
(45) Date of Patent: Dec. 11, 2012

(54) ARC TUBE FOR DISCHARGE BULB

(75) Inventors: Terutoshi Sako, Shizuoka (JP); Yuichiro Fujino, Shizuoka (JP); Takuya Serita, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/085,548

(22) Filed: Apr. 13, 2011

(65) Prior Publication Data

US 2011/0254438 A1 Oct. 20, 2011

(30) Foreign Application Priority Data

Apr. 15, 2010 (JP) ..... 2010-093952

(51) Int. Cl.
*H01J 17/18* (2012.01)

(52) U.S. Cl. ..... 313/623; 445/27

(58) Field of Classification Search ..... 313/623, 313/318.07; 445/27

See application file for complete search history.

(56) References Cited

U.S. PATENT DOCUMENTS

2002/0008477 A1* 1/2002 Leichtfried et al. ..... 313/623

FOREIGN PATENT DOCUMENTS

JP 11-67153 A 3/1999
JP 2003-86136 A 3/2003

* cited by examiner

*Primary Examiner* — Anne Hines
(74) *Attorney, Agent, or Firm* — Sughrue Mion, PLLC

(57) ABSTRACT

An arc tube for a discharge bulb, comprising a sealed glass bulb in which luminous materials are sealed; a plurality of pinch-sealed portions made of quartz glass and formed at both end portions of the sealed glass bulb; a plurality of molybdenum foils each pinch sealed in the corresponding pinch-sealed portion; a pair of electrode rods provided in the sealed glass bulb so as to face each other, wherein each of electrode rods extends from the sealed glass bulb to the corresponding pinch-sealed portion and is connected to one end of the corresponding molybdenum foil; and a plurality of lead wires each connected to the other end of the corresponding molybdenum foil, wherein the molybdenum foils comprise a plurality of closed cavities therein.

11 Claims, 5 Drawing Sheets

*FIG. 5*

| MO FOIL TREATMENT | SAMPLE | DOWNTIME (HOURS) |
|---|---|---|
| FIRST EXAMPLE OXIDATION/REDUCTION (500℃ OXIDATION + 900℃ REDUCTION) | No. 1 | 2364 |
| | No. 2 | 2684 |
| | No. 3 | 2752 |
| | No. 4 | 2988 |
| | AVERAGE | 2697 |
| SECOND EXAMPLE VACUUM HEAT TREATMENT (900℃) | No. 1 | 2092 |
| | No. 2 | 2340 |
| | No. 3 | 2444 |
| | No. 4 | 2720 |
| | AVERAGE | 2399 |
| THIRD EXAMPLE HYDROGEN TREATMENT (900℃) | No. 1 | 2044 |
| | No. 2 | 2140 |
| | No. 3 | 2600 |
| | No. 4 | 2888 |
| | AVERAGE | 2418 |
| COMPARATIVE EXAMPLE WITHOUT RECRYSTALLIZATION TREATMENT | No. 1 | 1176 |
| | No. 2 | 1212 |
| | No. 3 | 1304 |
| | No. 4 | 1744 |
| | AVERAGE | 1359 |

ARC TUBE FOR DISCHARGE BULB

CROSS-REFERENCE TO RELATED APPLICATION

This application claims priority from Japanese Patent Application No. 2010-093952, filed on Apr. 15, 2010, the entire contents of which are hereby incorporated by reference.

BACKGROUND

1. Technical Field

The present disclosure relates to an arc tube for discharge bulb, including a sealed glass bulb where electrodes are provided in a sealed glass bulb so as to face each other and luminous materials are enclosed.

2. Related Art

In an arc tube disclosed in JP-A-11-067153 and JP-A-2003-86136, electrodes are provided in a sealed glass bulb so as to face each other. The sealed glass bulb is formed by pinch-sealing regions of an electrode assembly, where molybdenum foils are present, by quartz glass and sealing luminous materials and the like. In the electrode assembly, electrode rods, molybdenum foils, and lead wires are integrally connected in series. If the molybdenum foils at high temperature are recrystallized and crystal grains of the molybdenum foils are roughened when a glass tube is to be pinch-sealed, the value of stress, which is generated at the interface between the molybdenum foil and quartz glass by the turning on/off of the arc tube, is increased. For this reason, the molybdenum is likely to peel off from foil glass, which causes a sealing gas to leak at a pinch-sealed portion. In JP-A-11-067153 and JP-A-2003-86136, a technique for solving the above problem has been described.

In JP-A-11-067153, the size of the recrystallized grains of the molybdenum foil at the pinch-sealed portion is set to 50 μm or less, so that stress repeatedly generated at the interface between the molybdenum foil and quartz glass by the turning on/off of an arc tube is reduced.

In JP-A-2003-86136, the surface of a molybdenum foil at a pinch-sealed portion is formed of a roughened surface, which is subjected to an etching treatment including oxidation and reduction, to increase adhesion (mechanical bond strength) between molybdenum foil and glass. Accordingly, even though stress is repeatedly generated at the interface between the molybdenum foil and quartz glass by the turning on/off of an arc tube, the molybdenum foil is not likely to peel off from glass.

In the disclosure of JP-A-11-067153 and JP-A-2003-86136, it is advantageous in preventing the molybdenum foil from peeling off from the glass at the pinch-sealed portion to some extent. However, in manufacturing the arc tube disclosed in JP-A-11-067153 and JP-A-2003-86136, the inventor has produced a prototype of an arc tube using a molybdenum foil that is subjected to a vacuum heat treatment (about 900° C.) or a hydrogen treatment (about 900° C.) (a molybdenum foil whose the crystal grain size is in a range of about 1 to 1.5 μm by a primary recrystallization, instead of a molybdenum foil that is subjected to an etching treatment including oxidation and reduction (a molybdenum foil having a rough surface) as the molybdenum foil (the molybdenum foil used for connecting the electrode rod with the lead wire) of the electrode assembly. Consequently, when pinch-sealing is performed at a relatively high temperature, it was possible to suppress the molybdenum foil from peeling off from the glass, which causes a sealing gas to leak at a pinch-sealed portion, while the life of the arc tube is lengthened.

That is, it was possible to obtain a result that the separation between glass and the molybdenum foil is suppressed even though the surface of the molybdenum foil at the pinch-sealed portion does not have an extremely roughened surface structure for increasing the adhesion (mechanical bond strength) between the molybdenum foil and glass.

Accordingly, the inventor carefully observed the cross-section of the molybdenum foil of this prototype in order to look into this cause. As a result, a plurality of closed cavities, which had not been seen in a comparative example (an arc tube using a molybdenum foil that is not subjected to a primary recrystallization treatment) at all, was seen in the molybdenum foil. That is, closed cavities (cavities reliably separated from a glass layer) are formed in the molybdenum foil at the pinch-sealed portion. Accordingly, it is confirmed that the cavities (a porous structure of the molybdenum foil including a plurality of closed cavities) reduce stress generated at the interface between the molybdenum foil and quartz glass when the arc tube is turned on/off and are advantageous in suppressing the occurrence of the peeling off of molybdenum from glass.

In addition, even in the case of the arc tube of JP-A-2003-86136 (a roughened surface structure where the surface of the molybdenum foil at the pinch-sealed portion increases the adhesion between the glass and molybdenum foil), when the molybdenum foil (a molybdenum foil whose crystal grain size is in a range of about 1 to 1.5 μm by a primary recrystallization) subjected to an oxidation (about 500° C.)/reduction (about 900° C.) treatment, which is a primary recrystallization treatment, is pinch-sealed at a relatively high temperature, closed cavities are formed in the molybdenum foil. Accordingly, it is confirmed that the adhesion (mechanical bond strength) between the glass and the molybdenum foil is increased by the rough surface structure of the surface of the molybdenum foil and a porous structure in the molybdenum foil is advantageous in suppressing the occurrence of the peeling off of molybdenum from glass.

SUMMARY OF THE INVENTION

Exemplary embodiments of the present invention may address the above disadvantages and other disadvantages not described above. However, the present invention is not required to overcome the disadvantages described above, and thus, an exemplary embodiment of the present invention may not overcome any disadvantages.

In an illustrative aspect of the present invention may provide an arc tube for a discharge bulb whose life is lengthened through the suppression of the peeling off of molybdenum from glass.

According to one or more aspects of the present invention, an arc tube for a discharge bulb, comprising a sealed glass bulb in which luminous materials are sealed; a plurality of pinch-sealed portions made of quartz glass and formed at both end portions of the sealed glass bulb; a plurality of molybdenum foils each pinch sealed in the corresponding pinch-sealed portion; a pair of electrode rods provided in the sealed glass bulb so as to face each other, wherein each of electrode rods extends from the sealed glass bulb to the corresponding pinch-sealed portion and is connected to one end of the corresponding molybdenum foil; and a plurality of lead wires each connected to the other end of the corresponding molybdenum foil, wherein the molybdenum foils comprise a plurality of closed cavities therein.

Other aspects and advantages of the present invention will be apparent from the following description, the drawings and the claims.

BRIEF DESCRIPTION OF THE DRAWINGS

FIG. 5 is a view comparing data of life tests of the arc tubes (examples), which use molybdenum foils subjected to a primary recrystallization treatment (an oxidation/reduction treatment, a vacuum heat treatment, and a hydrogen treatment), with data of a life test of the arc tube (comparative example) that uses a molybdenum foil not subjected to a primary recrystallization treatment.

DETAILED DESCRIPTION OF EXEMPLARY EMBODIMENTS

An embodiment of the invention will be described below with reference to examples.

Figure 1:
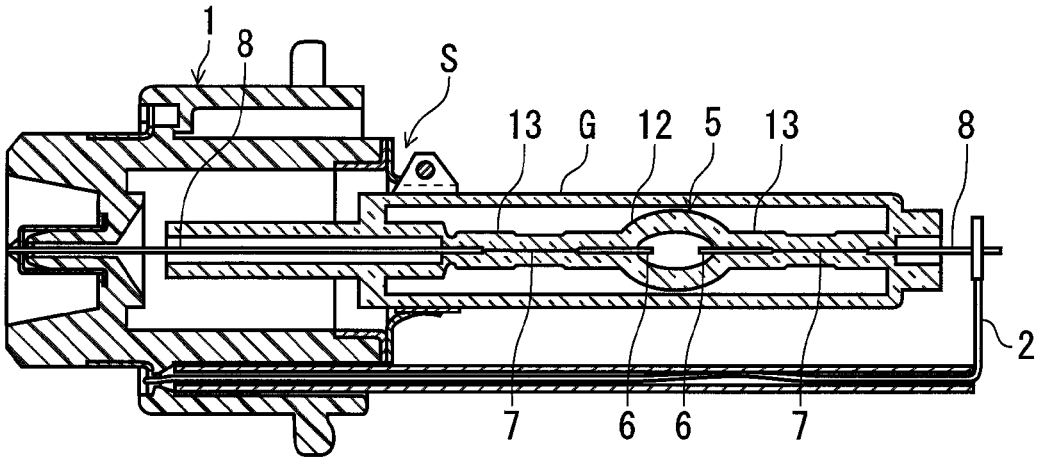
FIG. 1 is a longitudinal sectional view of the entire discharge bulb including an arc tube according to an embodiment.
Figure 2:
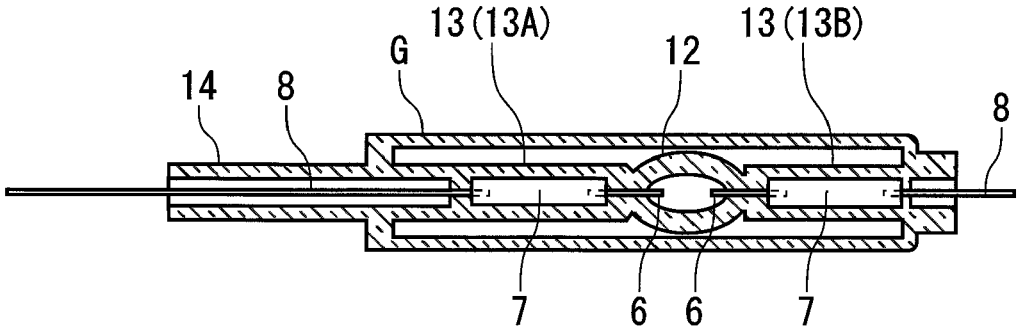
FIG. 2 is a horizontal sectional view of the arc tube according to the embodiment.

FIGS. 1 and 2 show an example where the invention is applied to a discharge bulb widely used as a light source of a vehicle headlamp. FIG. 1 shows the entire discharge bulb, and FIG. 2 shows an arc tube for a discharge bulb.

As shown in FIG. 1, front and rear end portions of an arc tube 5 of a discharge bulb are supported by a lead support 2 that functions as a current path protruding toward the front side of an insulating base 1 and a grip member S that is fixed to the front surface of the insulating base 1 and is made of metal. The arc tube 5 is integrated with the insulating base 1.

A quartz glass tube, which has the shape of a cylindrical pipe, includes a spherical swelling portion that is formed in the middle of a linear extension portion in the longitudinal direction of the linear extension portion. Portions of the quartz glass tube, which are close to the spherical swelling portion, are pinch-sealed, so that an ellipsoidal sealed glass bulb 12 for forming a discharge space is formed. The arc tube 5 has a structure where pinch-sealed portions 13 (a primary pinch-sealed portion 13A and a secondary pinch-sealed portion 13B) having a rectangular cross-section are formed at both end portions of the ellipsoidal sealed glass bulb 12. A starting rare gas, mercury or a buffer material used instead of mercury, and a metal halide (hereinafter, referred to as luminous materials and the like) are sealed in the sealed glass bulb 12.

Further, electrode rods 6 and 6, which form discharge electrodes and are made of tungsten, are disposed in the sealed glass bulb 12 so as to face each other. The electrode rods 6 and 6 are connected to molybdenum foils 7 and 7 that are sealed in the pinch-sealed portions 13 and 13. Lead wires 8 and 8, which are made of molybdenum and connected to the molybdenum foils 7 and 7, are led from end portions of the pinch-sealed portions 13 and 13. The rear lead wire 8 extends to the outside through a cylindrical pipe-like portion 14 that is a portion not pinch-sealed.

That is, an electrode rod made of tungsten, which is excellent in durability, is most preferable as the electrode rod 6. However, the coefficient of linear expansion of tungsten is significantly different from that of glass, and tungsten is incompatible with glass and has inferior airtightness. For this reason, the molybdenum foil 7, whose coefficient of linear expansion is close to that of glass and which is relatively compatible with glass, is connected to the electrode rod 6 made of tungsten and the molybdenum foil 7 is sealed in the pinch-sealed portion 13, so that airtightness is secured at the pinch-sealed portion 13.

Further, a shroud glass G for blocking ultraviolet light is integrated with the arc tube 5 by welding so that the region between the sealed glass bulb 12 and the pinch-sealed portions 13 is covered with the shroud glass G. Accordingly, ultraviolet components, which correspond to a wavelength range harmful to a human body, of light emitted from the arc tube 5, are cut down, and the region between the sealed glass bulb 12 and the pinch-sealed portions 13 is surrounded by an enclosed space that is formed by the shroud glass G, so that a high temperature is maintained in the sealed glass bulb 12.

Furthermore, in manufacturing the arc tube 5, an electrode assembly where the electrode rods 6, the molybdenum foils 7, and the lead wires 8 are integrally connected in series is prepared in advance and the electrode assembly is inserted into a quartz glass tube. Then, a region of the quartz glass tube, which includes the molybdenum foil 7 of the electrode assembly, is pinch-sealed, so that a primary pinch-sealed portion 13A is formed. After that, luminous materials and the like are injected into the sealed glass bulb 12, and the other end region of the quartz glass tube, which includes the molybdenum foil 7 of the electrode assembly, is pinch-sealed, so that a secondary pinch-sealed portion 13B is formed. Then, the luminous materials and the like are sealed.

Since a process for manufacturing the arc tube 5 is disclosed in detail in JP-A-2003-86136, the description thereof will be described.

Figure 3:
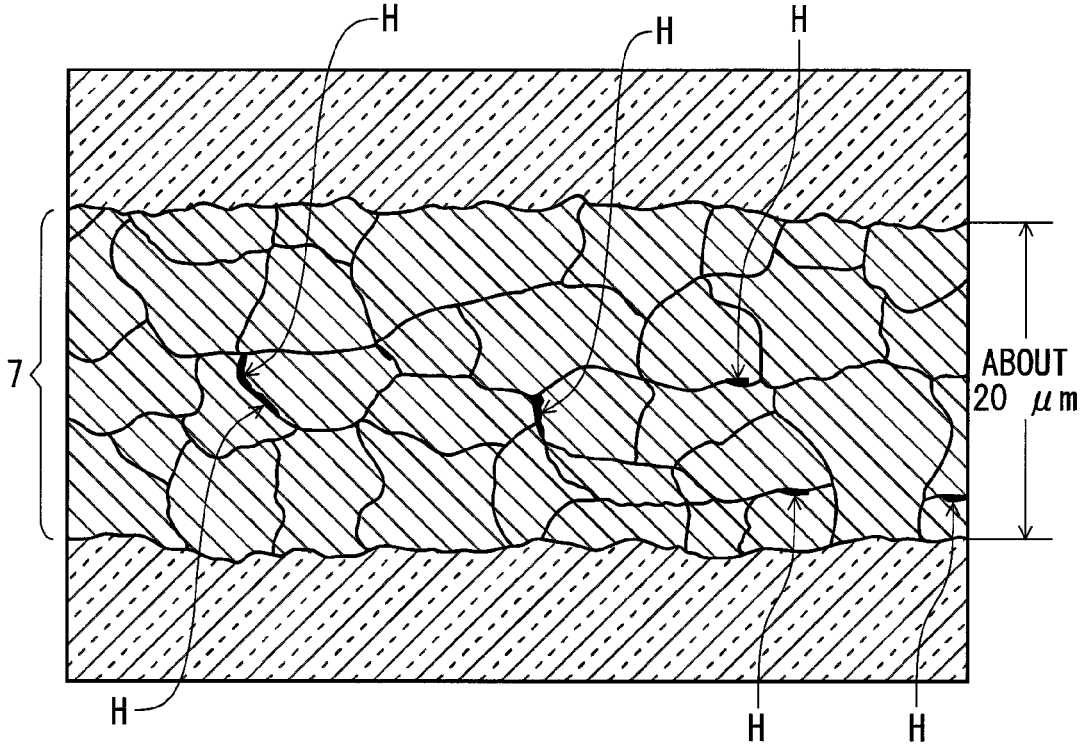
FIG. 3 is an enlarged sectional view of a molybdenum foil that is sealed in a pinch-sealed portion of the arc tube according to the embodiment.

The external structure of the arc tube 5 shown in FIGS. 1 and 2 is also not different from that of the well-known arc tube disclosed in JP-A-11-067153 and JP-A-2003-86136. However, as shown in the enlarged sectional view of FIG. 3, the molybdenum foil 7 sealed in the pinch-sealed portion 13 is formed of recrystallized grains having an average grain size of about 3 to 5 μm and has a porous structure where closed cavities H are dispersed in a glass layer. Accordingly, stress, which is generated at the interface between the molybdenum foil 7 and quartz glass by the turning on/off of the arc tube 5, is relieved (reduced) by the porous structure of the molybdenum foil 7, so that the peeling off of molybdenum from glass, causing sealing gas to leak at the pinch-sealed portion 13, is suppressed.

That is, the molybdenum foil 7 is made of molybdenum into which 0.5% of yttria ($Y_2O_3$) is doped (added). However, a primary recrystallization treatment is performed first, so that the average grain size of the crystal grains of the molybdenum foil is changed to the range of about 1 to 1.5 μm from about 0.5 μm. Further, pinch-sealing is performed by quartz glass (a secondary recrystallization treatment is performed at a pinch seal temperature of 2200 to 2300° C.), so that the molybdenum foil 7 has a porous structure where the average grain size of the crystal grains is about 3 to 5 μm, a thickness is about 20 μm, and a plurality of cavities H is dispersed.

In detail, since the coefficient of linear expansion of the molybdenum foil 7 is different from that of quartz glass, stress is generated at the interface between the molybdenum foil 7 and quartz glass at the pinch-sealed portion 13 by the turning on/off of the arc tube 5. However, the porous structure of the molybdenum foil 7 (cavities formed in the molybdenum foil) relieves (reduces) the stress generated at the interface between the molybdenum foil 7 and quartz glass and suppresses the peeling off of molybdenum from glass, causing a sealing gas to leak at the pinch-sealed portion 13.

Meanwhile, the recrystallization of the molybdenum foil starts at a temperature of about 800 to about 1200° C. However, when the quartz glass tube is to be pinch-sealed, the molybdenum foil is crushed while being exposed to a high temperature, which exceeds 2000° C., through quartz glass and the like. For this reason, the crystals of the molybdenum foil are recrystallized and roughened.

Further, since the number of grain boundaries of the crystals is small if (the size of) the recrystallized grains of the pinch-sealed molybdenum foil 7 are excessively large, voids (cavities) are not easily formed. If voids (cavities) are formed, the size of the voids (cavities) is excessively increased and the voids (cavities) reach the surface of the molybdenum foil. For this reason, closed cavities are not formed in the glass layer. As a result, a function of relieving (reducing) stress, which is generated at the interface between the molybdenum foil and quartz glass when the arc tube is turned on/off, is low. Meanwhile, since voids (cavities) to be formed in the molybdenum foil 7 are small if (the size of) the recrystallized grains of the pinch-sealed molybdenum foil 7 are excessively small, a function of relieving (reducing) stress, which is generated at the interface between the molybdenum foil 7 and quartz glass when the arc tube is turned on/off, is low.

Moreover, as a result of the consideration of the cross-sectional structure of a prototype, it is advantageous that the average grain size of the crystal grains of the molybdenum foil 7 sealed in the pinch-sealed portion 13 be in a range of about 3 to 5 μm in order to make a plurality of closed cavities H be formed in the molybdenum foil 7 (to make the molybdenum foil 7 have a porous structure).

In addition, in order to make the average grain size of the crystal grains of the molybdenum foil 7 sealed in the pinch-sealed portion 13 be in the range of about 3 to 5 μm, it is advantageous to adjust the average grain size of the crystal grains of the molybdenum foil to the range of about 1 to about 1.5 μm by performing a primary recrystallization treatment on the molybdenum foil that is not yet pinch-sealed.

Meanwhile, for example, a method of performing a reduction treatment at a temperature of about 900° C. after performing an oxidation treatment at a temperature of about 500° C., a method of performing a vacuum heat treatment at a temperature of about 900° C., a method of performing a hydrogen treatment at a temperature of about 900° C., and the like are considered as the primary recrystallization treatment of the molybdenum foil 7. However, as long as the size (average grain size) of the crystal grains of the molybdenum foil 7 can be changed to the range of about 1 to 1.5 μm from about 0.5 μm, the primary recrystallization treatment is not limited to these methods.

Next, there will be described a mechanism for forming closed cavities in a glass layer in the molybdenum foil 7 that is sealed in the pinch-sealed portion 13 (a mechanism for making the molybdenum foil 7 have a porous structure).

Since a temperature where a quartz glass tube is pinch-sealed is set to be high (about 2200 to 2300° C.) in the range of a general pinch seal temperature (about 2000 to 2300° C.) which is well-known in the related art JO-73), the molybdenum foil (whose crystal grain size is in the range of about 1 to 1.5 μm), which is primarily recrystallized by any one treatment of an oxidation (about 500° C.)/reduction (about 900° C.) treatment, a vacuum heat treatment (about 900° C.), and a hydrogen treatment (about 900° C.), is secondarily recrystallized (a crystal grain size is in the range of about 3 to 5 μm) by being exposed to the high temperature where the quartz glass tube is pinch-sealed. However, parts of the recrystallized crystal grains are deviated from each other and voids are formed between the crystal grains due to the internal stress that is generated while all the recrystallized crystal grains (whose crystal grain size is in the range of about 3 to 5 μm) are contracted (cooled) after being thermally expanded. Accordingly, it is considered that these voids form a plurality of closed cavities in the molybdenum foil 7 (the molybdenum foil has a porous structure).

In detail, when the pinch-sealed portion 13 having reached a high temperature is cooled, the contraction of the surface layer portion of the molybdenum foil 7 coming into close contact with the glass layer is suppressed by the glass layer but the inner portion of the molybdenum foil 7 can be freely contracted. For this reason, stress is generated between the crystal grains of the surface layer portion of the molybdenum foil and the crystal grains of the inner portion of the molybdenum foil, and the adjacent crystal grains are deviated from each other due to this stress. Accordingly, it is considered that voids are formed along boundaries of the crystal grains and a plurality of closed cavities H is formed in the molybdenum foil 7 due to the voids (the molybdenum foil has a porous structure).

Meanwhile, if the pinch seal temperature of the quartz glass tube is 2230° C., a plurality of cavities is seen in the molybdenum foil. However, if the pinch seal temperature of the quartz glass tube is 2150° C., a plurality of cavities is not seen in the molybdenum foil at all. Accordingly, in order to form cavities H in the molybdenum foil, it is preferable to set the pinch seal temperature to about 2200° C. or more. That is, if the pinch seal temperature of the quartz glass tube is lower than about 2200° C., small stress is generated between the crystal grains of the surface layer portion of the molybdenum foil and the crystal grains of the inner portion of the molybdenum foil when the pinch-sealed portion, which has reached a high temperature due to pinch sealing, is cooled. For this reason, since adjacent crystal grains are not deviated from each other, it is considered that voids are not formed at the boundaries of the crystal grains (cavities H are not formed in the molybdenum foil).

Meanwhile, if the pinch seal temperature of the quartz glass tube is high, the stress generated between the crystal grains of the surface layer portion of the molybdenum foil and the crystal grains of the inner portion of the molybdenum foil is large. Accordingly, the deviation between adjacent crystal grains is large, so that a plurality of large voids can be formed at the boundaries of the crystal grains (many cavities H are formed in the molybdenum foil). Therefore, the pinch seal temperature of the quartz glass tube is preferably high. However, if the pinch seal temperature of the quartz glass tube exceeds 2300° C., a burner and a pincher need to be made of a material excellent in heat resistance and large thermal energy used to heat quartz glass is also needed.

Accordingly, in order to form closed cavities H in a glass layer in the molybdenum foil 7 that is sealed in the pinch-sealed portion 13 (in order to make the molybdenum foil 7 have a porous structure), it is preferable to set a pinch seal temperature to the range of about 2200 to 2300° C.

Figure 4:
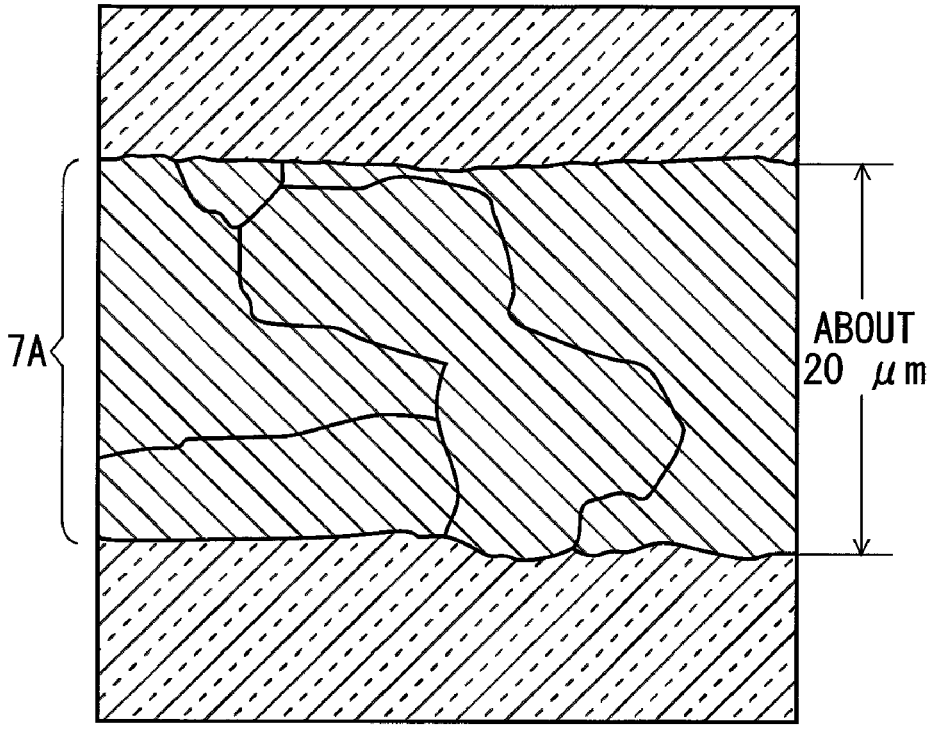
FIG. 4 is an enlarged sectional view of a molybdenum foil (a molybdenum foil that is not subjected to a primary recrystallization treatment) that is sealed in a pinch-sealed portion of an arc tube according to a comparative example.

Further, in an arc tube (comparative example) that is pinch-sealed using a molybdenum foil (whose average grain size of crystal grains is about 0.5 μm) not subjected to a primary recrystallization treatment, as shown in FIG. 4, the average grain size of the recrystallized crystal grains of a molybdenum foil 7A at a pinch-sealed portion is approximately in the range of about 20 to 30 μm which is larger than the thickness (about 20 μm) of the molybdenum foil and cavities are not seen in the molybdenum foil 7A at all. Accordingly, in order to form closed cavities H in the molybdenum foil 7A at the pinch-sealed portion 13 (in order to make the molybdenum foil 7A have a porous structure), it is advantageous to adjust the average grain size of the crystal grains of the molybdenum foil to the range of about 1 to 1.5 μm by previously performing a primary recrystallization treatment on the molybdenum foil that is not yet pinch-sealed.

Furthermore, in the arc tube 5 according to this example, the porous structure of the molybdenum foil 7 at the pinch-sealed portion 13 (the cavities H formed in the molybdenum foil 7) relieves (reduces) the stress generated at the interface between the molybdenum foil 7 and quartz glass and suppresses the peeling off of molybdenum from glass, causing a sealing gas to leak at the pinch-sealed portion 13. Accordingly, the long life of the arc tube is ensured as shown in FIG. 5.

Moreover, the molybdenum foil 7 is primarily recrystallized, so that fine irregularities are formed on the surface of the molybdenum foil 7. In particular, if a surface etching treatment using oxidation (500° C.) and reduction (900° C.) is employed as the primary recrystallization treatment of the molybdenum foil 7, an oxide film is formed on the surface of an oxidized molybdenum foil and oxygen atoms are removed from the oxide film by a reduction treatment. Accordingly, a rough surface (etched surface) having the shape of fine irregularities, which are deeper and more complicated than fine irregularities formed on the surface of the oxidized molybdenum foil, is formed on the surface of the molybdenum foil. Therefore, the adhesion, that is, mechanical bond strength at the interface between quartz glass and the molybdenum foil is also improved. As a result, the separation between glass and the molybdenum foil is further suppressed.

FIG. 5 is a view comparing data of life tests of the arc tubes (first, second, and third examples), which use molybdenum foils subjected to an oxidation/reduction treatment, a vacuum heat treatment, and a hydrogen treatment as a primary recrystallization treatment, with data of a life test of the arc tube (comparative example) that uses a molybdenum foil not subjected to a primary recrystallization treatment. However, it was found that an arc tube (first example) using a molybdenum foil subjected to an oxidation/reduction treatment as a primary recrystallization treatment is the most excellent among the first to third examples, even from the data of life tests, that is, from the fact that the average life of an arc tube is 2697 hours when an oxidation/reduction treatment is employed as a primary recrystallization treatment, the average life of an arc tube is 2399 hours when a vacuum heat treatment is employed as a primary recrystallization treatment, and the average life of an arc tube is 2418 hours when a hydrogen treatment is employed as a primary recrystallization treatment.

While aspects of embodiments of the present invention have been shown and described above, other implementations are within the scope of the claims. It will be understood by those skilled in the art that various changes in form and details may be made therein without departing from the spirit and scope of the invention as defined by the appended claims.

The invention claimed is:

1. An arc tube for a discharge bulb, comprising
- a sealed glass bulb in which luminous materials are sealed;
- a plurality of pinch-sealed portions made of quartz glass and formed at both end portions of the sealed glass bulb;
- a plurality of molybdenum foils each pinch sealed in the corresponding pinch-sealed portion;
- a pair of electrode rods provided in the sealed glass bulb so as to face each other, wherein each of electrode rods extends from the sealed glass bulb to the corresponding pinch-sealed portion and is connected to one end of the corresponding molybdenum foil; and
- a plurality of lead wires each connected to the other end of the corresponding molybdenum foil,
- wherein the molybdenum foils comprise a plurality of closed cavities therein.

2. The arc tube for of claim 1, wherein an average grain size of crystal grains of the molybdenum foil is in the range of about 3 to 5 μm.

3. The arc tube according to claim 1, wherein the molybdenum foils are
- subjected to any one treatment of an oxidation/reduction treatment, a vacuum heat
- treatment, and a hydrogen treatment, prior to being pinch sealed so that an average grain
- size of crystal grains of the molybdenum foil is in the range of about 1 to 1.5 μm.

4. The arc tube according to claim 1, wherein the molybdenum foil is doped with 0.5% yttria ($Y_2O_3$).

5. The arc tube according to claim 1, wherein the pinched-sealed portions are formed at a temperature equal to or greater than 2200° C. and less than or equal to 2300° C.

6. The arc tube for of claim 1, wherein the molybdenum foil has a porous structure.

7. A method of manufacturing an arc tube for a discharge bulb, the method comprising:
- providing a molybdenum foil in the arc tube;
- performing a primary recrystallization treatment on the molybdenum foil; and
- performing a secondary recrystallization treatment on the molybdenum foil forming pinched-sealed portions to form a plurality of closed cavities in the molybdenum foil.

8. The method of claim 7, wherein the primary recrystallization treatment on the molybdenum foil comprises any one treatment of an oxidation/reduction treatment, a vacuum heat treatment, and a hydrogen treatment.

9. The method of claim 7, wherein an average grain size of crystal grains of the molybdenum foil is about 0.5 μm prior to the primary recrystallization treatment.

10. The method of claim 7, wherein an average grain size of crystal grains of the molybdenum foil is in the range of about 1 to 1.5 μm prior to the secondary recrystallization treatment.

11. The method of claim 7, wherein the pinched-sealed portions are formed at a temperature equal to or greater than 2200° C. and less than or equal to 2300° C.

* * * * *